US006635130B2

(12) United States Patent
Koch

(10) Patent No.: US 6,635,130 B2
(45) Date of Patent: Oct. 21, 2003

(54) PYROTECHNIC COMPOSITION FOR PRODUCING IR-RADIATION

(75) Inventor: Ernst-Christian Koch, Kaiserslautern (DE)

(73) Assignee: Diehl Munitionssysteme GmbH & Co. KG, Röthenbach (DE)

( * ) Notice: Subject to any disclaimer, the term of this patent is extended or adjusted under 35 U.S.C. 154(b) by 0 days.

(21) Appl. No.: 10/339,999

(22) Filed: Jan. 10, 2003

(65) Prior Publication Data

US 2003/0150535 A1 Aug. 14, 2003

Related U.S. Application Data

(63) Continuation-in-part of application No. 09/678,452, filed on Oct. 3, 2000, now abandoned.

(30) Foreign Application Priority Data

Oct. 9, 1999 (DE) ..... 199 64 172

(51) Int. Cl.[7] ..... C06B 45/10

(52) U.S. Cl. ..... 149/19.3; 149/87; 149/108.2; 149/116

(58) Field of Search ..... 149/116, 19.3, 149/108.2, 87

(56) References Cited

U.S. PATENT DOCUMENTS 3,929,918 A * 12/1975 Meshri et al. ..... 570/150
4,710,335 A * 12/1987 Kita et al. ..... 264/104
5,089,154 A * 2/1992 King ..... 508/112
5,114,811 A * 5/1992 Ebel et al. ..... 429/184
5,472,533 A * 12/1995 Herbage et al. ..... 149/22
5,585,594 A * 12/1996 Pelham et al. ..... 149/19.3
5,656,794 A * 8/1997 Krone et al. ..... 149/108.2
5,667,916 A * 9/1997 Ebel et al. ..... 429/219
5,834,680 A 11/1998 Nielson et al.
6,013,144 A * 1/2000 Callaway ..... 149/108.2
6,312,625 B1 * 11/2001 Nielson et al. ..... 149/108.2

OTHER PUBLICATIONS

Hawley, ed., "The Condensed Chemical Dictionary", 9$^{th}$ Ed., (1997) Van Nostrand Reinhold Company, New York, pp. 389–391, 705, 707, 840, 918, and 921.*

Takauo Kuwahara, "Burning Rate of Mg/TF Pyrolants" pp. 539–549.

T. Kuwahara, et al. "Combustion and Sensitivity Charateristics of Mg/TF Pyrolants" (1997), pp. 198–202.

* cited by examiner

*Primary Examiner*—Edward A. Miller
(74) *Attorney, Agent, or Firm*—Scully, Scott, Murphy & Presser

(57) ABSTRACT

A pyrotechnic active material for producing IR-radiation is proposed. An active material according to the invention contains fuel (preferably magnesium) which combines with fluorine in a strongly exergonic reaction (for example Li, Be, Mg, Ca, Sr, Ba, Ti, Zr, Hf, B, Al and alloys thereof) and poly-(carbon monofluoride) ((—$CF_x$—)n) (x=0.6–1.2) as an oxidation agent. Compositions according to the invention further contain VITON® as a polymeric binding agent and graphite for reduction of the electrostatic sensitivity. A process for producing those compositions is also provided.

11 Claims, No Drawings

PYROTECHNIC COMPOSITION FOR PRODUCING IR-RADIATION

RELATED APPLICATIONS

This application is a continuation-in-part application of U.S. application Ser. No. 09/678,452, filed Oct. 3, 2000, now abandoned.

FIELD OF THE INVENTION

The present invention relates to a pyrotechnic active material for producing infrared (IR) radiation.

BACKGROUND OF THE INVENTION

Hot bodies such as, for example, pyrotechnic flames emit visible light as well as infrared radiation. The radiation emission from hot bodies, such as pyrotechnic combustion products, is described by Planck's radiation law, which is shown in equation 1 hereinbelow. In accordance therewith, the total energy irradiated from a hot body per unit of surface area is proportional to the absolute temperature of the hot body. In addition, the emission maximum is also a function of temperature. The functional relationship is described by Wien's displacement law, which is shown in equation 2.

$$E(v) = \frac{8\pi v^3}{c^3 e(h - v/\lambda kT) - 1} \tag{1}$$

$$\lambda_{max}T = 0.289779 \text{ cm.K}^{-1} \tag{2}$$

The military sector for combating aerial targets such as, for example, jet aircraft, helicopters and transport machines, involves the use of missiles which target on and track the IR-radiation emitted by the propulsion unit of the aerial target, primarily in the range of between 0.8 and 5 $\mu$m, by means of an infrared radiation-sensitive seeker head.

To provide a defense against missiles from such aerial targets, decoy bodies are used, which are pyrotechnic IR-radiating devices that imitate the IR-signature of the target.

In order to produce radiation in the wavelength range which imitates the IR-signature of the target, the requirement is for a flame having a temperature of at least greater than 1700 K so that a sufficient level of IR-radiation density can be generated ($I_{0.8\text{-}5\ \mu m}$>0.2 kW.sr$^{-1}$.s$^{-1}$.cm$^2$). It will be appreciated, however, that pyrotechnic flames at that temperature generally provide very little IR-radiation. The deviation from Planck's law is to be attributed to the emissivity $\epsilon$ of the combustion products. Emissivity is a factor that describes the deviation of real radiating bodies from the ideal of the Planck's or black body. By definition, $\epsilon$=1 applies to a black body. All real radiating bodies always have emissivity values of less than 1 and, in many cases, less than 0.5. With the exception of hot compressed gases which have $\epsilon$-values greater than 0.9, typical reaction products of pyrotechnic reactions (MgO, KCI, $Al_2O_3$, etc.) have $\epsilon$-values of between 0.05–0.2. For that reason, in the development of IR-active materials, attention has been already paid, at a very early stage, to providing products which have a high level of emissivity. Those substances with a high $\epsilon$-value include, for example, carbon black ($\epsilon$=0.85). Thus, conventional active materials for producing black body radiation in the IR-range comprise Magnesium/TEFLON®/VITON®-mixtures (MTV). TEFLONS is a material that comprises polytetrafluoroethylene; while VITON® is a fluoroelastomeric material. Those prior art compositions upon combustion in accordance with equation 3 predominantly yield magnesium fluoride and carbon black.

$$2n\ \text{Mg}+(C_2F_4)_n \rightarrow 2n\ \text{MgF}_2+2n\text{C}+h.v \tag{3}$$

The effectiveness of the MTV-containing decoy (i.e., flare) against IR-seeker heads is based on the high level of heat of formation of magnesium fluoride as well as on the high level of emissivity of carbon black produced ($\epsilon$≈0.85) which, due to thermal excitation, has an almost black body-like emission On a number of occasions, attempts have been made to increase the pointance of such MTV-flares. For that purpose, conventional MTV-compositions are provided with additives, such as titanium, zirconium and/or boron for increasing the mass consumption rate. The use of such additives in conventional MTV-flares is described, for example, in T. Kuwahara, T. Ochiai, *Burning Rate of Mg&/TF Pyrolants,* 18$^{th}$ *International Pyrotechnics Seminar,* 1992, 539; and T. Kuwahara, S. Matsuo, N. Shinozaki, *Combustion and Sensitivity Characteristics of Mg/TF Pyrolans, Propellants, Explosives Pyrotechnics,* 22 (1997); 198–202.

The increase in the mass consumption rate $m_1$ means that it is possible to increase the radiance $I_\lambda$ (see equation 4).

$$I_\lambda = E_\lambda \cdot m_i \tag{4}$$

in which:

$E_\lambda$=specific intensity [kJ.g$^{-1}$.sr$^{-1}$]

$m_i$=mass consumption rate [g.s$^{-1}$.cm$^{-2}$]

$I_\lambda$=pointance [kW.sr$^{-1}$.cm$^{-2}$]

It will be appreciated, however, that these substances weaken the spectral intensity distribution to the detriment of the black body level insofar as selectively emitting oxidation products are formed.

SUMMARY OF THE INVENTION

An object of the present invention is to provide a pyrotechnic composition which, while retaining the known spectral characteristic of MTV decoys, has a substantially higher level of specific power.

Accordingly, pursuant to the present invention there is provided a pyrotechnic composition for producing IR-radiation which comprises, by weight, 10–72.5% of a poly-(carbon monofluoride) oxidation agent; 15–90% of a halophilic metallic fuel comprising a metal selected from the group consisting of magnesium, aluminum, titanium, zirconium, hafnium, calcium, beryllium boron and mixtures or alloys of said metals; 2.5 and 7.5% of an organic fluorine-bearing agent; and 0.1–5% of graphite. Note that the various components present in the pyrotechnic composition of the present invention add up to 100%.

The increase in power of the pyrotechnic composition of the present invention serves to simplify the manufacture of the munition. Now, the same level of power can be achieved with smaller amounts of pyrotechnics, whereby the risk of fire and explosion in manufacture is reduced. In spite of a reduction in the ingredients of the mixture by about 50%, the same amount of decoys of the same power can still be produced.

In addition by virtue of the reduction in the mass of the pyrotechnic payload, the munition becomes lighter, thereby also affording logistical advantages.

The present invention further prevents the formation of polyaromatic hydrocarbons (PAH) which are objectionable from the points of view of environment and human toxicology, as are produced in the combustion of MTV-flares.

The present invention is based on the consideration of deliberately and specifically producing upon combustion graphite, the substance with the highest level of emissivity ($\epsilon_{\lambda<5\ \mu m}$=0.95), which can be excited by the heat of the pyrotechnic reaction to afford thermal radiation. Furthermore, in accordance with the present invention, the reaction heat is markedly increased in comparison with the prior art systems. This can be affected by the use of substances with a lower level of molar enthalpy of formation, in comparison with TEFLON®.

DETAILED DESCRIPTION OF THE INVENTION

Various prior art approaches for the pyrotechnic production of graphite make use either of incomplete combustion of aromatic compounds (anthracene, naphthalene or their derivatives or homologues thereof) or the thermal decomposition of intercalation compounds of graphite (these are intercalation compounds in which the spaces between the individual graphite lattices can be occupied by foreign atoms or molecules, for example, anions or cations). Incomplete combustion of aromatic hydrocarbons has already found its way into the production of pyrotechnic black body radiator, see, for example, U.S. Pat. No. 5,834,680. It will be appreciated, however, that in the case of U.S. Pat. No. 5,834,680, only graphite-like pyrolysis products are formed, which suffer from surface contamination by low-molecular PAHs, for which reason their emissivity is markedly below that of graphite; in addition the PAH adhesions represent a toxicological potential which is not to be underestimated. The thermal decomposition of intercalation compounds of graphite has only been proposed for producing dipole aerosols for attenuating electromagnetic radiation, see, for example, DE 43 37 9071 C1.

In both U.S. Pat. No. 5,834,680 and DE 43 37 9071 C1, the graphite precursor, that is to say the aromatic (anthracene or decacyclene, respectively) or the intercalation compound of graphite does not contribute to the reaction heat, but rather acts as an endergonic additive which lowers the flame temperature (see U.S. Pat. No. 5,834,680, column 3, lines 23–25 and column 5, lines 18–21).

It has now been found by the present applicant that graphite can be produced by the reduction of poly-(carbon monofluoride) (PMF) by means of high-energy halophilic fuels. In accordance with the present invention, the term "PMF" denotes a polymeric graphite fluoride material that contains covalent bonds between the carbon and fluoride atoms, which has a quasi-infinite two-dimensional stratified structure. The term "PMF" may be interchangeably used with the term "graphite fluorinated polymer". Unlike the intercalation compounds of graphite, which are described and claimed in DE 43 37 9071 C1, there are true covalent bonds between the carbon and the fluorine atoms in the PMF material employed in the present invention. Therefore the formation of graphite by reductive elimination of the fluorine atoms in a PMF material is already favored just in relation to entropy, in comparison with the formation from condensed aromatics. In addition, the conversion of a formerly saturated system into an aromatic system ("graphen") should represent a thermodynamic advantage.

In accordance with the present invention, compositions are produced from poly-(carbon monofluoride) which contains a repeating unit of the formula ((—$CF_x$—)n) with a molar proportion of fluorine represented by x of between 0.6 to 1.2, preferably x is between 1 and 1.2 or x is less than 1.1; and n is the number of repeating $CF_x$ moieties present in the polymeric material. The value of n is dependent upon the dimensions of the CF particles and the desired molecular weight of the polymeric material. The poly-(carbon monofluoride) employed in the present invention may include PMF materials having CAS Registration Nos. [51311-17-2] (PMF material where x is between 1 and 1.2) and [11113-63-6] (which is a PMF material where x less than 1.1). The particle sizes of the PMF material may vary, but typically, the particles sizes are less than 50 $\mu$m. The PMF material is present in the pyrotechnic composition of the present invention in an amount, based by weight, of from 10–72.5%, with an amount of from 20–70% being more highly preferred.

In addition to the PMF material which is used as an oxidation agent, the pyrotechnic composition of the present invention also includes as a halophilic metallic fuel which contains a metal selected from the group consisting of magnesium, aluminum, titanium, zirconium, haffium, calcium, beryllium, boron and mixtures thereof including alloys of the aforementioned metals. The halophilic fuel preferably contains magnesium metal. The halophilic fuel is present in the pyrotechnic composition of the present invention in an amount, based by weight, of 15–90%, with an amount of from 40–70% being more highly preferred.

In accordance with the present invention, the pyrotechnic composition of the present invention further includes an organic fluorine-bearing binding agent. Specifically, the binding agent used is a combustion-supporting fluorine-bearing elastomer based on hexafluoropropylene-vinylidene difluoride copolymer, for example Fluorel FC 2175™, in proportions by mass of between 2.5 and 7.5%. Other organic fluorine-bearing binding agents that can be employed in the present invention are a series of fluoroelastomers based on the copolymer of vinylidene fluoride and hexafluoropropylene with the repeating structure —$CF_2$—$CH_2$—$CF_2$—CF($CF_3$)— which are sold under the tradename known as VITON®.

To reduce the electrostatics sensitivity of the pyrotechnic composition of the present invention, graphite powder is used, with a specific resistance of less than $7\times10^{-5}\ \Omega.m^{-1}$, in proportions by mass of from 0.1 to 5%.

In a preferred embodiment of the present invention, the pyrotechnic composition includes magnesium (Mg)/PMF/VITON® hereinafter referred to as the "MPV" system.

The advantages of the MPV system as well as the other pyrotechnic compositions of the present invention will become apparent upon comparison with the prior art magnesium/polytetrafluoroethylene/VITON® (hereinafter referred to as "MTV") system; in the prior art MTV system the polytetrafluoroethylene is TEFLON®:

In the reaction of PMF with magnesium, magnesium fluoride and graphite are formed in accordance with equation 5:

$$n\ Mg+2(—CF—)_n \rightarrow n\ MgF_2+2n\ C_{graphite}+h.v \quad (5)$$

By virtue of the fluorine content of PMF, which is lower in comparison with PTFE, the ideal stoichiometry (see equation 3) occurs with a proportion of magnesium ξ(Mg) of 0.29, in comparison with TEFLON® in which the ideal stoichiometry (see equation 1) is reached with a proportion ξ(Mg) of 0.32. Because the heat of formation of PMF (−175 $kJ.mol^{-1}$) is just one fifth as great as that of TEFLON® (−854 $kJ.mol^{-1}$), the heat of the reaction of magnesium with PMF is consequently also considerably higher than the heat of reaction for the prior art magnesium/TEFLON® system.

The specific power ($E_{2\text{-}3\ \mu m}$ and $E_{3\text{-}5\ \mu m}$) of the MPV pyrotechnic composition of the present invention is correspondingly high. Admittedly the specific power, in the region $\xi(Mg)>45$, approaches the values for the mass consumption rate compared with prior art Mg/PTFE/VITON® compositions. The radiance $I_\lambda$ is therefore always higher by a factor of 10 in the case of Mg/PMF/VITON® compositions of the present invention, than in the case of the prior art Mg/PTFE/VITON® compositions of comparable composition.

Therefore, in relation to the proportion of magnesium, compositions produced in accordance with the present invention afford a level of radiance which is higher by a factor of 10 than the previously known prior art Mg/PTFE/VITON® compositions.

The example set out hereinafter is intended to illustrate the present invention without limiting it.

EXAMPLE 1

55 g of PMF was stirred into a suspension comprising 40 g of magnesium, 5 g VITON® and 1 g of graphite powder and 200 ml of acetone. The suspension was stirred in a flow of air until a crumbly material was produced. The solvent-moist granular material was passed through a sieve (2.5 mm mesh size) and dried at 40° C. in a flow of air for 5 hours. The granular material was processed with a 6 sec. holding time with 12 tonnes pressing pressure to give cylindrical pellets a mass of 40 g of a 25 mm caliber.

The results of radiometric measurement are set out in Table 1 with the measurement values for the Mg/PTFE/VITON® system which is of a similar composition; In the table, Sample 1 is representative of the present invention, whereas Sample 2 is a prior art pyrotechnic composition:

TABLE 1

| | 1 | 2 | Quotient 1/2 |
|---|---|---|---|
| Magnesium | 40% | 40% | |
| Poly-(carbon monofluoride) | 55% | — | |
| Polytetrafluoroethylene | — | 55% | |
| VITON | 5% | 5% | |
| Burning time [sec] | 2.66 | 11.5 | 0.2 |
| $E_{2-3\ \mu m}$ [$kJ \cdot g^{-1} \cdot sr^{-1}$] | 0.170 | 0.100 | 1.7 |
| $E_{3-5\ \mu m}$ [$kJ \cdot g^{-1} \cdot sr^{-1}$] | 0.157 | 0.080 | 2.0 |
| Mass Consumption rate $g \cdot s^{-1} \cdot cm^{-2}$] | 3.003 | 0.700 | 4.3 |
| $I_{2-3\ \mu m}$ [$kW \cdot sr^{-1} \cdot cm^{-2}$] | 0.511 | 0.070 | 7.3 |
| $I_{3-5\ \mu m}$ [$kW \cdot sr^{-1} \cdot cm^{-2}$] | 0.472 | 0.056 | 8.4 |

While the present invention has been particularly shown and described with respect to preferred embodiments thereof, it will be understood by those skilled in the art that the foregoing and other changes in forms and details may be made without departing from the spirit and scope of the present invention. It is therefore intended that the present invention not be limited to the exact forms and details described and illustrated, but fall within the scope of the appended claims.

What is claimed is:

1. A pyrotechnic composition for producing IR-radiation comprising, by weight, (a) 10–72.5% of a poly-(carbon monofluoride) material; (b) 15–90% of a halophilic metallic fuel comprising a metal selected from the group consisting of magnesium, aluminum, titanium, zirconium, hafnium, calcium, beryllium, boron and mixtures or alloys thereof; (c) 2.5–7.5% of an organic fluorine-bearing binding agent; and (d) 0.1–5% of graphite, wherein components (a)–(d) add up to 100%.

2. The pyrotechnic composition of claim 1 wherein said halophilic metallic fuel comprises magnesium.

3. The pyrotechnic composition of claim 1 wherein said poly-(carbon monofluoride) material has repeating units of the formula $(—CF_x—)_n$ wherein x is between 0.6 to 1.2; and n is the number of repeating $CF_x$ moieties present in the material.

4. The pyrotechnic composition of claim 3 wherein x is between 1 and 1.2.

5. The pyrotechnic composition of claim 3 wherein x is less than 1.1.

6. The pyrotechnic composition of claim 1 wherein from 20–80% of said poly-carbon monofluoride) is present in said composition.

7. The pyrotechnic composition of claim 1 wherein said organic fluorine-bearing binder is a hexafluoropropylene-vinylidene difluoride copolymer.

8. The pyrotechnic composition of claim 1 wherein said organic fluorine-bearing binder is a fluoroelastomer based on the copolymer of vinylidene fluoride and hexafluoropropylene with a repeating structure $—CF_2—CH_2—CF_2—CF(CF_3)—$.

9. The pyrotechnic composition of claim 1 wherein said halophilic metallic fuel is present in an amount of between 40–70%.

10. The pyrotechnic composition of claim 1 wherein said graphite is graphite powder having a specific resistance of less than $7\times10^{-5}\ \Omega.m^{-1}$.

11. The pyrotechnic composition of claim 1 comprising 55% of said poly-carbon monofluoride), 40% magnesium, and 5% of a fluoroelastomer based on the copolymer of vinylidene fluoride and hexafluoropropylene with a repeating structure $—CF_2—CH_2—CF_2—CF(CF_3)—$.

* * * * *